US010454177B2

(12) United States Patent
Kozyrev

(10) Patent No.: US 10,454,177 B2
(45) Date of Patent: Oct. 22, 2019

(54) TRANSVERSE ELECTROMAGNETIC HORN ANTENNA HAVING A CURVED SURFACE

(71) Applicant: BAE SYSTEMS INFORMATION AND ELECTRONIC SYSTEMS INTEGRATION INC., Nashua, NH (US)

(72) Inventor: Alexander B. Kozyrev, Rockville, MD (US)

( * ) Notice: Subject to any disclaimer, the term of this patent is extended or adjusted under 35 U.S.C. 154(b) by 166 days.

(21) Appl. No.: 15/373,562

(22) Filed: Dec. 9, 2016

(65) Prior Publication Data

US 2018/0166786 A1 Jun. 14, 2018

(51) Int. Cl.
*H01Q 13/02* (2006.01)
*H01Q 13/08* (2006.01)
*H01Q 21/08* (2006.01)

(52) U.S. Cl.
CPC ..... *H01Q 13/02* (2013.01); *H01Q 13/085* (2013.01); *H01Q 21/08* (2013.01)

(58) Field of Classification Search
CPC ..... H01Q 13/02; H01Q 13/085; H01Q 21/08
See application file for complete search history.

(56) References Cited

U.S. PATENT DOCUMENTS 3,204,243 A 8/1965 Rubin et al.
4,246,584 A * 1/1981 Noerpel ..... H01P 1/16 333/242
5,973,653 A * 10/1999 Kragalott ..... H01Q 13/08 343/767
7,084,823 B2 * 8/2006 Caimi ..... H01Q 1/36 343/742
2009/0051467 A1 * 2/2009 McKinzie, III ..... H01P 1/16 333/219

OTHER PUBLICATIONS

Mallahzadeh, Ali Reza, and Fardad Karshenas. "Modified TEM horn antenna for broadband applications." Progress in Electromagnetics Research 90 (2009): 105-119.

* cited by examiner

*Primary Examiner* — Hoang V Nguyen
*Assistant Examiner* — Awat M Salih
(74) *Attorney, Agent, or Firm* — Sand, Sebolt & Wernow LPA; Scott J. Asmus

(57) ABSTRACT

The current disclosure is directed to a radar system. More particularly, the current disclosure relates to a fabrication of aperture-matched array of TEM horn antenna system and use of the same. Specifically, the current disclosure is directed to a compact and lightweight impulse radiating TEM array antenna system with high forward-to-back lobe ratio. Furthermore, the current TEM horn antenna system shows radiation efficiency close to 1 at the frequency bands between 150 and 250 MHz. More particularly, the current disclosure provides transverse electromagnetic (TEM) horn antenna including a curved surface extending arcuately at least 180° degrees from an antenna aperture opening defined at a signal-receiving forward end of a horn structure, wherein the curved surface is adapted to suppress large back-lobe properties.

8 Claims, 7 Drawing Sheets

TRANSVERSE ELECTROMAGNETIC HORN ANTENNA HAVING A CURVED SURFACE

STATEMENT OF GOVERNMENT INTEREST

The invention was made with government support under Contract No. W9113M-08-C-0030 awarded by the United States Department of the Army. The government has certain rights in the invention.

BACKGROUND

Technical Field

Generally, the present disclosure relates to a high power microwave system. More particularly, the present disclosure relates to fabrication of aperture-matched array of TEM antenna and use of the same. Specifically, the current disclosure is directed to a compact and lightweight impulse radiating TEM array antenna with high main-to-back lobe ratio.

Background Information

A transverse electromagnetic (TEM) horn antenna is a parallel plate waveguide which acts as an impedance transformer. Conventional TEM horn antennas use a uniform linear or exponentially tapering profile for impedance transformation starting from a feeding point to the antenna aperture. However, in the conventional TEM horn antenna, the increase of aperture dimension for a given length of the horn may lead to undesirable phase variations of radiating field in its aperture as the wave becomes spherical. This reduces aperture efficiency and consequently reduces the gain and the power delivered to the target. To avoid gain reduction and power reduction, a large horn length is essential which makes the antenna structure impractically long in the frequency range of interest (150-250 MHz). Furthermore, conventional TEM horn antennas have significant back radiation resulting from the reflecting from the aperture edges. However, reduction of the TEM antenna size typically results in stronger back-lobe radiation.

SUMMARY

Thus, an improved TEM horn antenna system is needed. The present disclosure addresses this need by providing a compact TEM horn antenna structure and increases forward lobe and suppresses back-lobe radiation simultaneously.

The current disclosure is directed to a radar system. More particularly, the current disclosure relates to an aperture-matched array of TEM horn antenna system and use of the same. Specifically, the current disclosure is directed to a compact and lightweight impulse radiating TEM array antenna system with high forward-to-back lobe ratio. Furthermore, the current TEM horn antenna system shows radiation efficiency close to 1 at the frequency bands between 150 and 250 MHz.

In one aspect, the present disclosure may provide a TEM horn antenna, comprising, a parallel plate waveguide section, an exponential tapered flare section, a curved section; and wherein a first end of the exponential tapered flare section is connected with the parallel plate waveguide section and a second end of the exponential flare section is connected with the curved section.

In another aspect, an embodiment of the present disclosure may provide a TEM horn antenna comprising: a parallel plate waveguide section, wherein the parallel plate waveguide section includes an upper dielectric plate and a lower dielectric plate; an exponentially flared section, wherein the exponentially flared section includes a top surface and bottom surface; a curved section, wherein the curved section includes a first curved section and a second curved section; and wherein a first end of the exponentially flared section is connected with the parallel plate waveguide section and a second end of the exponential flare section is connected with the curved section. This embodiment may further provide wherein the curved section arcuately extends from the second end of the flare section to a free terminal end. This embodiment may further provide wherein the terminal end is located at least 270° from a connection of the curved section with the second end of the exponential flare section. This embodiment may further comprise a radius of curvature of the curved section is in a range from about 4 inches to about 6 inches. This embodiment may further provide a generally cylindrical piece of foam positioned within the curved section and structurally supporting the same. This embodiment may further provide wherein a metal layer is provided on an outer surface of the parallel plate waveguide section, the exponential tapered flare section, and the curved section. This embodiment may further provide wherein a radius of curvature of the flare section is greater than a radius curvature of the curved section. This embodiment may further provide a metal layer along an outer surface of the curve section spanning more than 180° adapted to be matched to a wavelength and overall antenna aperture defined at the second end of the exponentially flared section. This embodiment may further provide the antenna, in combination with three other identical antennas arranged in an array to define a TEM horn antenna array system.

In another aspect, the present disclosure may provide a TEM horn antenna, comprising a parallel plate waveguide section, wherein the parallel plate waveguide section includes an upper plate and lower plate, an exponential tapered flare section, wherein the exponential tapered flare section includes a top surface and bottom surface, a curved section, wherein the curved section includes a first curved section and a second curved section; and wherein a first end of the exponential tapered flare section is connected with the parallel plate waveguide section and a second end of the exponential flare section is connected with the curved section.

In yet another aspect, an embodiment of the present disclosure provides a TEM horn antenna array having a curved surface arcuately extending at least 180 degrees from an aperture opening defined at a forward end of a horn structure, wherein the curved surface is adapted to suppress large back-lobe properties.

BRIEF DESCRIPTION OF THE SEVERAL VIEWS OF THE DRAWINGS

A sample embodiment of the present disclosure is set forth in the following description, is shown in the drawings and is particularly and distinctly pointed out and set forth in the appended claims.

Similar numbers refer to similar parts throughout the drawings.

DETAILED DESCRIPTION

The present disclosure relates to a transverse electromagnetic (TEM) horn antenna array which can maximize the aperture efficiency without making the antenna structure too long. In order to maximize the aperture efficiency without making the antenna structure too long, in-phase aperture distortion by multi-point array type excitation is attained. The TEM horn antenna array presents as a hybrid radiating structure which is a discrete co-phased array by its feed network. Further, the TEN horn antenna array is an aperture antenna by the radiation mechanism that takes advantage of the modular nature of the TEM antenna system. In order to suppress the large back-lobe radiation issue, a curved surface section has been attached to the outside of the aperture edges.

Figure 1:
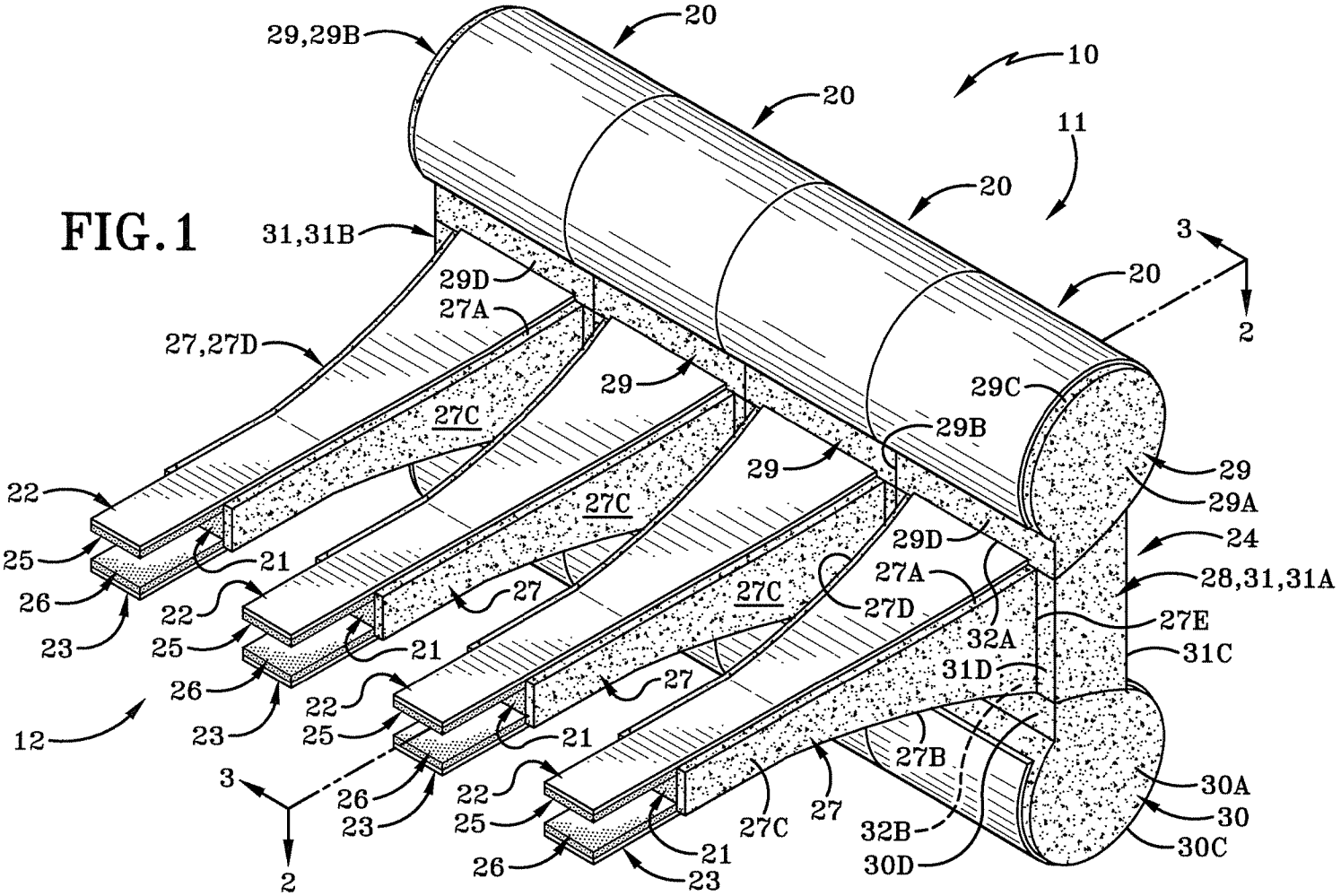
FIG. 1 is a top-rear perspective view of a TEM horn array antenna system in accordance with the present disclosure.

FIG. 1 illustrates a present embodiment of a TEM horn antenna array system generally at 10. The system 10 includes a forward end 11 opposite a rear end 12. The forward end is oriented towards an incoming signal such that received signals travel from the forward end 11 of antenna system 10 towards the rear end 12.

The TEM horn antenna array system 10 may comprise one or more TEM horn antennas 20. Each TEM horn antenna 20 is oriented such that its forward end is oriented with forward end 11 and its rear end is oriented with rear end 12 of system 10. Each TEM horn antenna 20 comprises a top metal layer 22, a bottom metal layer 23, a dielectric foam structure 24, a top dielectric plate 25, a bottom dielectric plate 26, and a triangular wedge 21.

The foam structure 24 comprises a central portion 28, an upper cylindrical portion 29, and lower cylindrical portion 30. The central portion 28 further comprises a rearwardly extending extension portion 27 and a base portion 31. The extension portion 27 further comprises a top surface 27A, a bottom surface 27B, a first side surface 27C, a second side surface 27D, and a front surface 27E. Base 31 and extension portion 27 are formed as a single piece of foam during actual construction but are described separately with distinct reference numerals.

Figure 1A:
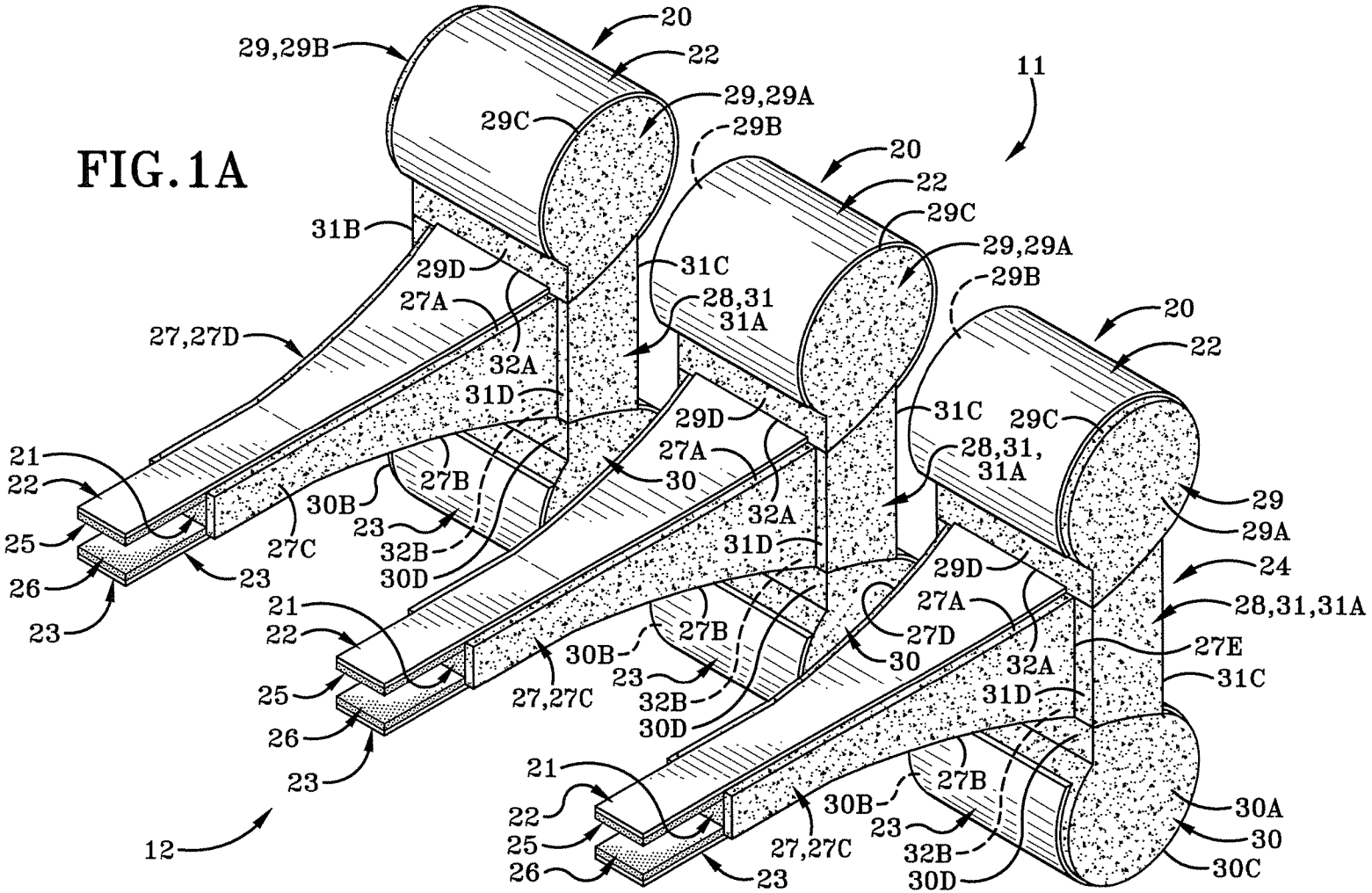
FIG. 1A is a top-rear exploded perspective view the TEM horn array antenna system depicting individual antennas individually separated.

As depicted in FIG. 1A, the upper cylindrical portion 29 comprises a first side surface 29A, a second side surface 29B, an upper round surface 29C, and a rear surface 29D. The lower cylindrical portion 30 comprises a first side surface 30A, a second side surface 30B, a lower round surface 30C, and a rear surface 30D.

The base portion 31 comprises a first side surface 31A, a second side surface 31B, a front surface 31C, and a rear surface 31D. A first rectangular channel 32A is formed between the upper cylindrical portion 29 and the base portion 31. A second rectangular channel 32B is formed between the lower cylindrical portion 30 and the base portion 31. The first channel 32A extends from the rear surface 31D to the front surface 31C of the base portion 31 along an outer perimeter of the upper cylindrical portion 29. Similarly, the second channel 32B extends from the rear surface 31D to the front surface 31C of the base portion 31 along an outer perimeter of the lower cylindrical portion 30. The upper cylindrical portion 29 is attached on a top of the base portion 31. The lower cylindrical portion 30 is attached underneath the base portion 31. The extension portion 27 is attached on the rear surface 31D of the base portion 31 and extends rearwardly toward rear end 12 of antenna 20.

Figure 3A:
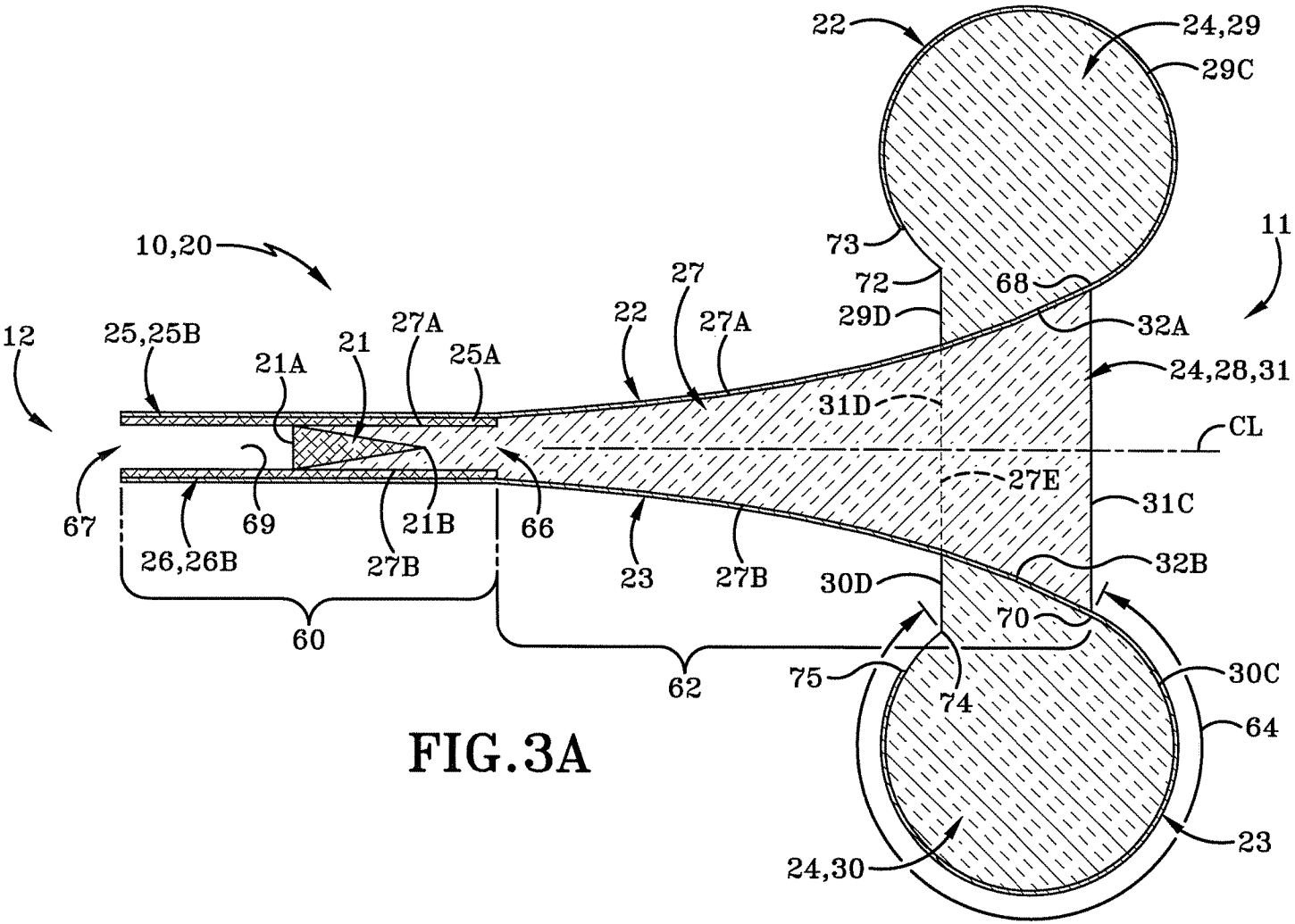
FIG. 3A is a cross section taken along line 3-3 in FIG. 1.
Figure 3B:
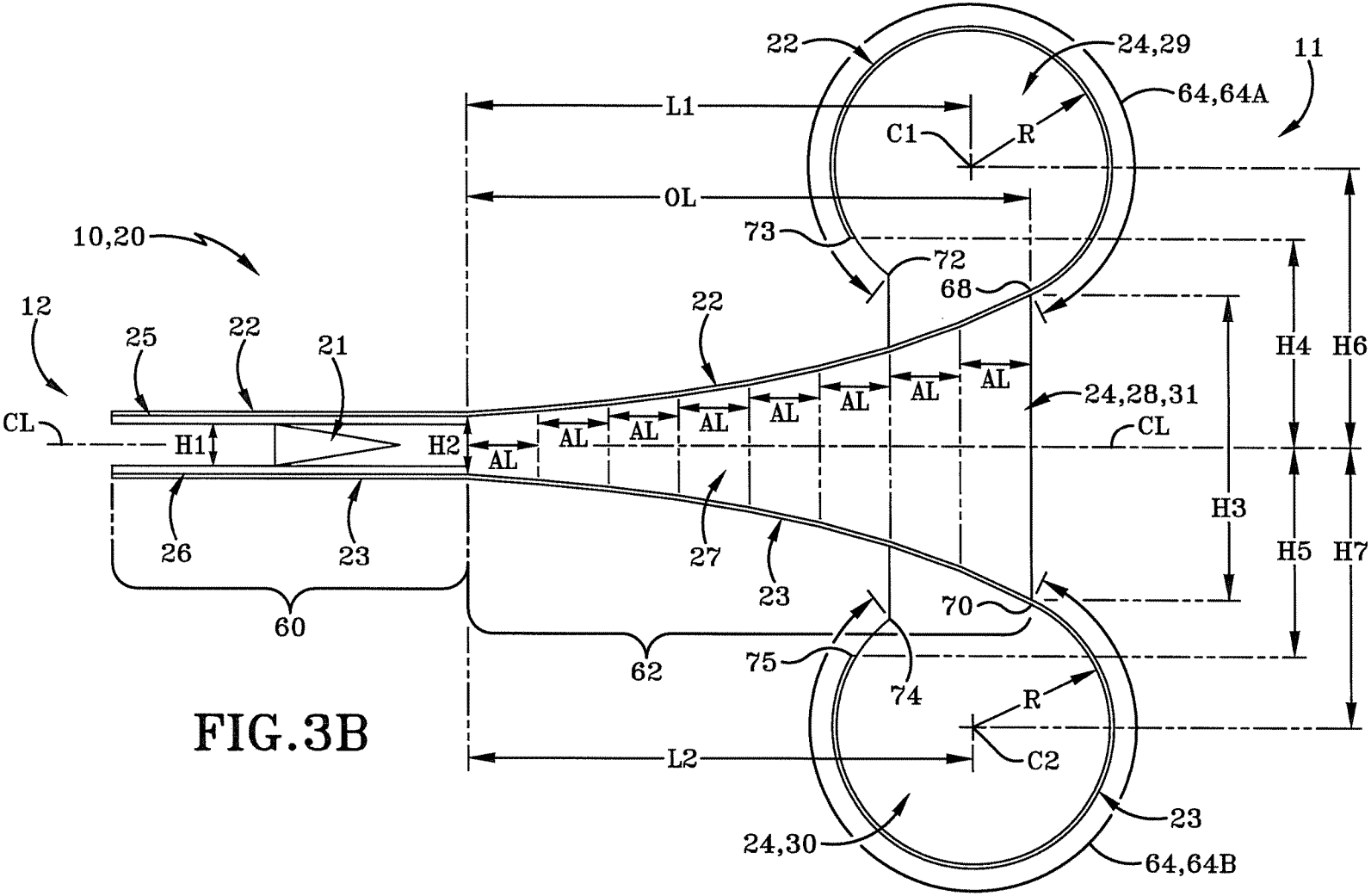
FIG. 3B is a cross section taken along line 3-3 in FIG. 1, similar to FIG. 3A but depicting different reference numerals for clarity so as to avoid confusion between elements identified in FIG. 3A.

As depicted in FIG. 3A and FIG. 3B, the TEM horn antenna 20 may be explained as having (for descriptive purposes, but not necessarily divided in actual fabrication) a parallel waveguide section 60, a flared section 62, and curved section 64. The parallel waveguide section 60 includes the top and bottom dielectric plates 25, 26 and the triangular wedge 21. The triangular wedge 21 is located between the top and bottom plates 25, 26 of the dielectric foam structure 24. The wedge 21 contains not metal on it. In one embodiment, wedge 21 may be formed from dielectric material. The tapered wedge of dielectric material enables a gradual change in the dielectric properties between the dielectric plates 25, 26 and the portions of the antenna 20 positioned forwardly therefrom.

As shown in FIG. 3A and FIG. 3B, the wedge 21 is a tapered shape so that the wedge 21 has a triangular shape in cross section. A rear end or base 21A of the wedge 21 is fully extended to touch the top and bottom dielectric plates 25, 26. In one example, base 21A has a height of about 1.228 inches. A front apex 21B of the wedge 21 does not touch any of the plates 25, 26. The wedge 21 is inserted into the foam structure 24 so that the wedge 21 is firmly in contact with the foam structure 24. The top and bottom dielectric plates 25, 26 extends from a rear end 67 of the parallel waveguide section 60 to a feeding point 66 where the exponentially tapered flare section 62 begins. In one embodiment plates 25, 26 are formed from 0.183 inch Rogers dielectric material.

As depicted in FIG. 3A and FIG. 3B, a forward portion 25A of the top dielectric plate 25 is positioned above of the top surface 27A of extension portion 27 at its rear end. A forward portion 26A of the bottom dielectric plate 26 is positioned below the bottom surface 27B of extension portion 27 at its rear end. A rear portion 25B of the top dielectric plate 25 and a rear portion 26B of the bottom dielectric plate 26 are not positioned above or below the foam structure 24. As such, the second portions 25B, 26B of the top and bottom dielectric plates 25, 26 define a cavity 69 therebetween, wherein the cavity 69 is used to connect with other external components. The wedge 21 is located in cavity 69 between the first portion 25A of the top plate dielectric plate 25 and the first portion 26A of the bottom dielectric plate 26. In this particular exemplary, a length between the rear end 67 of the parallel waveguide section 60 to the rear end 21A of the wedge 21 is in a range from about 4 inches to about 8 inches. In one particular embodiment, the length from end 67 to end 21A is about 5 inches, and in one exact embodiment it is 5.58 inches. A length between the rear end 21A of the wedge 21 to the feeding point 66 is in a range from about 4 inches to about 8 inches, and more particularly could be 5.45 inches. Furthermore, the height (H1) between the top and bottom dielectric plates 25, 26 is in a range from about 0.5 inch to about 2 inches, and in one exact embodiment may be 1.228 inches.

As depicted in FIG. 3A and FIG. 3B, the top and bottom dielectric plates 25, 26 of the parallel waveguide section 60 extend offset parallel relative to each other about a centerline (CL) from the rear end 67 of top and bottom plates 25, 26 to the feeding point 66. Then, at the feeding point 66, the top surface 27A of the extension portion 27 begins to extend upwardly and in an exponential shape to an upper curvature point 68 of the extension portion. Similarly, the bottom surface 27B of the extension portion 27 begins to extend downwardly and exponentially to a lower curvature point 70 of the extension portion 27. As extended from the feeding point 66 to first and second curvature points 68, 70, a height (H2) between the top surface 27A and the bottom surface 27B of the structure 24 becomes exponentially larger. In this particular exemplary, the height (H2) between the top surface 27A and the bottom surface 27B of the extension portion 27 at the rear feeding point 66 is in a range from about 0.5 inch to about 2 inches, and in one exact embodiment may be 1.228 inches. As the extension portion 27 extends to the first and second curvature points 68, 70, the height (H3) gradually (in an exponentially curved manner) increases up to 10 inch.

An overall length (OL) of the flare section 62 may be divided into a plurality of antenna lengths (AL) as indicated in FIG. 3B. In this particular exemplary, each unit antenna length (AL) is set to around 2.5 inch. The AL correspondence to an operating frequency of the antenna system 10. Moreover, the flare section 62 comprises eight antenna lengths (AL). Therefore, the overall length (OL) of the flare section 62 is set to around 20 inch. The antenna length (AL) is critical in designing a TEM antenna because wavelength of a TEM antenna is based on the size of the antenna length (AL). For example, if a TEM antenna is designed for 1 GHz, each of those sections will be much shorter.

As shown in FIG. 3B, at the first and second curvature points 68, 70, the curved section 64 begins. An upper curved section 64A starts from the first curvature point 68 to a terminal end 73. A lower curved section 64B starts from the second curvature point 70 to a terminal end 75. A curvature of the flare section 62 is greater than a curvature of the curved section 64 so that the curvature of the curved section 64 is sharper than that of the flare section 62. For this particular exemplary, the radius (R) of the upper and lower curved section 64A, 64B is set to around 5 inch. As depicted in FIG. 3B, the radius (R) of the upper and lower curved section 64A, 64B may be uniform between their first curvature points 68,70 and their terminal ends 73,75, respectively. Furthermore, a first length (L1) between the feeding point 66 to an upper center point (C1) of the upper curved section 64A is 17.906 inches. A second length (L2) between the feeding point 66 to a lower center point (C2) of the lower curved section 64B is set to around 17.906 inch.

As depicted in FIG. 3A and FIG. 3B, the top metal layer 22 is positioned above the top dielectric plate 25 and a bottom metal layer 23 is positioned below the bottom dielectric plate 26. The top metal layer 22 extends continuously above the top surface 27A of the extended portion 27 to the upper curvature point 68. Similarly, the bottom metal layer 23 extends continuously below the bottom surface 27B of the extended portion 28 to the lower curvature point 70. At the upper curvature point 68, the top metal layer 22 is rolled around the upper round surface 29C of the upper cylinder portion 29 in the first curved section 64A. Similarly, at the lower curvature point 70, the bottom metal layer 23 is rolled around the lower round surface 30C of the lower cylinder portion 30 in the lower curved section 64B. However, the top metal layer 22 is extendedly rolled around to a first free terminal end 73 and the bottom metal layer 23 is extendedly rolled around to a second free terminal 75. A height (H4) between a center line (CL) to the first terminal end 73 may be in a range from about 5 inches to about 10 inches, but in one particular example is about 7 inches. Similarly, a height (H5) between the center line (CL) to the second terminal end 75 may be in a range from about 5 inches to about 10 inches, but in one particular example is about 7 inches. A height (H6) between the center line (CL) to the upper center point (C1) of the upper curved section 64A may be in a range from about 7 inches to about 12 inches, but in one particular example is about 9.5 inches. Similarly, a height (H7) between the center line (CL) to the lower center (C2) may be in a range from about 7 inches to about 12 inches, but in one particular example is about 9.5 inches. The metal layer 22 is only about 3 millimeters thick and may be copper however other low-loss metals could be utilized. The aperture opening for antenna 20 is defined as a plane extending vertically between points 68, 70 as would be understood in a conventional TEM horn antenna. Each curved section 64A, 64B extends at least 180° from its connection with the forward end of the flare section. In one particular embodiment, the curved sections 64A, 64B extend greater than 270° from their respective connections at points 68, 70 to free terminal ends 73, 75. The curved section 64 extending arcuately and rearwardly from the antenna aperture assist in reducing or suppressing back lobe radiation during antenna operation.

Figure 2:
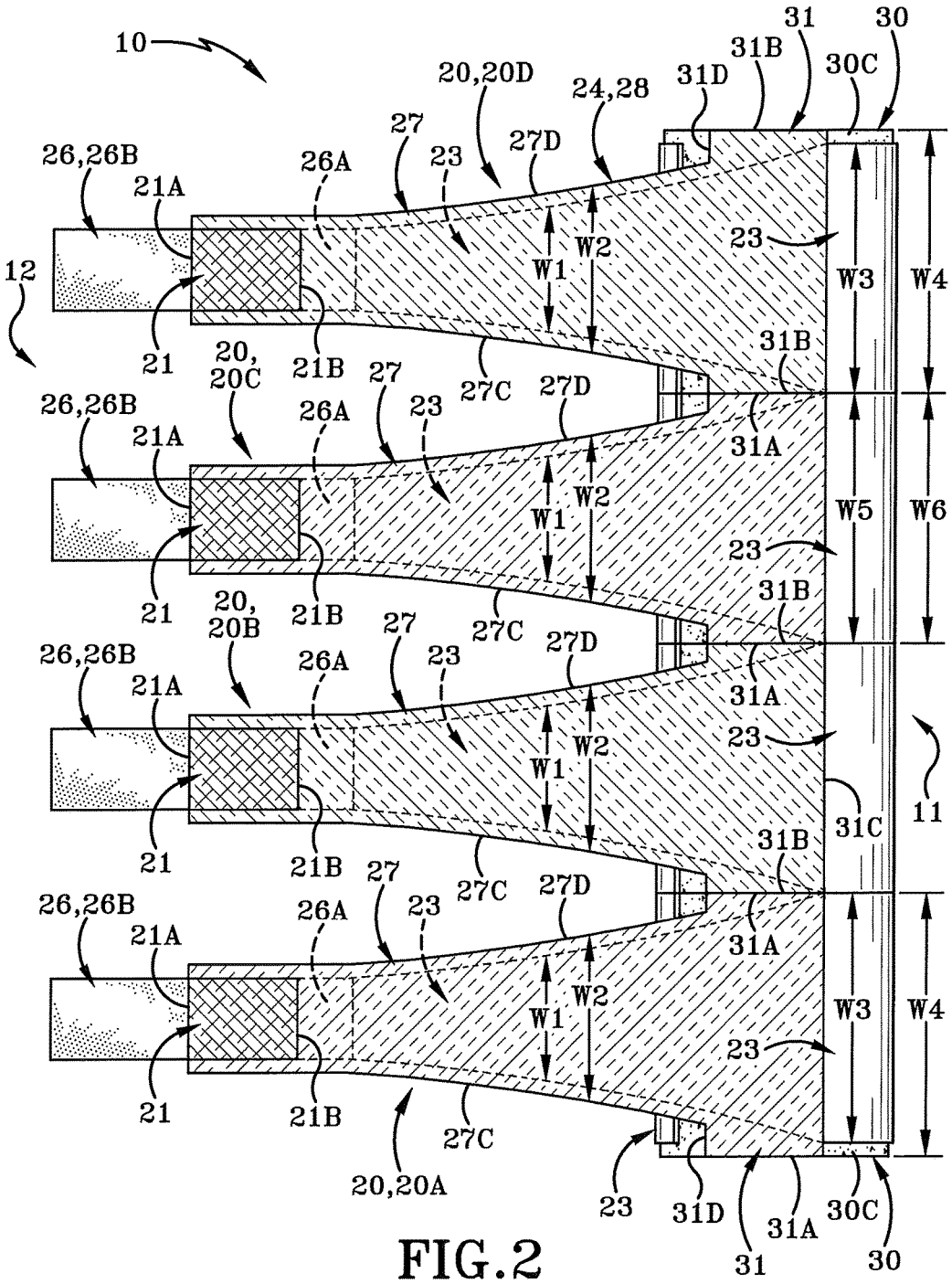
FIG. 2 is a cross section taken along line 2-2 in FIG. 1.

As depicted in FIG. 2, the first, second, third, and fourth antennas may be respectively identified as 20A, 20B, 20C, and 20D. With respect to the first antenna 20A and the fourth TEM antenna 20D, a width (W1) of the foam extension portion 27 is greater than a width (W2) of the bottom metal layer 23. Similarly, a width (W4) of the foam lower cylindrical portion 30 is greater than a width (W3) of the bottom metal layer 23. For the second and third TEM antennas 20B, 20C, a width (W1) the foam extension portion 27 is greater than a width (W2) of the bottom metal layer 23, however, a width (W6) of the lower cylindrical portion 30 is equal to a width (W5) of the bottom metal layer 23. In another example, the width (W6) the lower cylindrical portion 30 can be greater than the width (W5) of the bottom metal layer 23. The same structural configuration can be applied for the top metal layer 22 and the lower round surface 30C of the lower cylindrical portion 30.

Figure 4A:
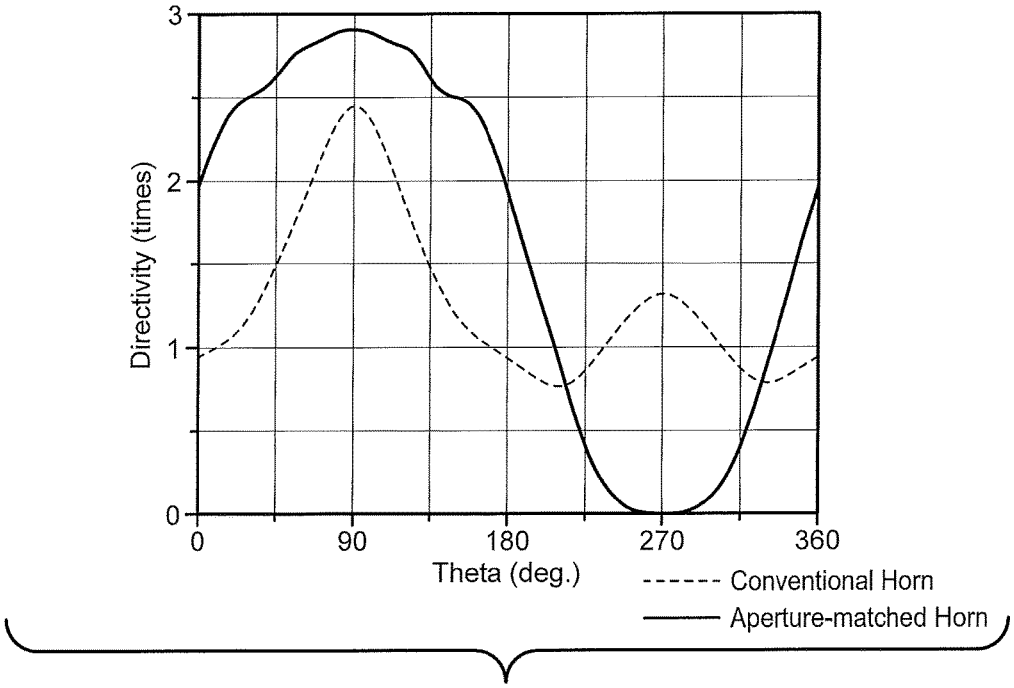
FIG. 4A is a first graph comparing linear directivity between a conventional TEM horn antenna and the TEM horn array antenna system with respect to a first polarization (Theta) at the output of the antenna and the angel with respect to the center boresight of the antenna.
Figure 4B:
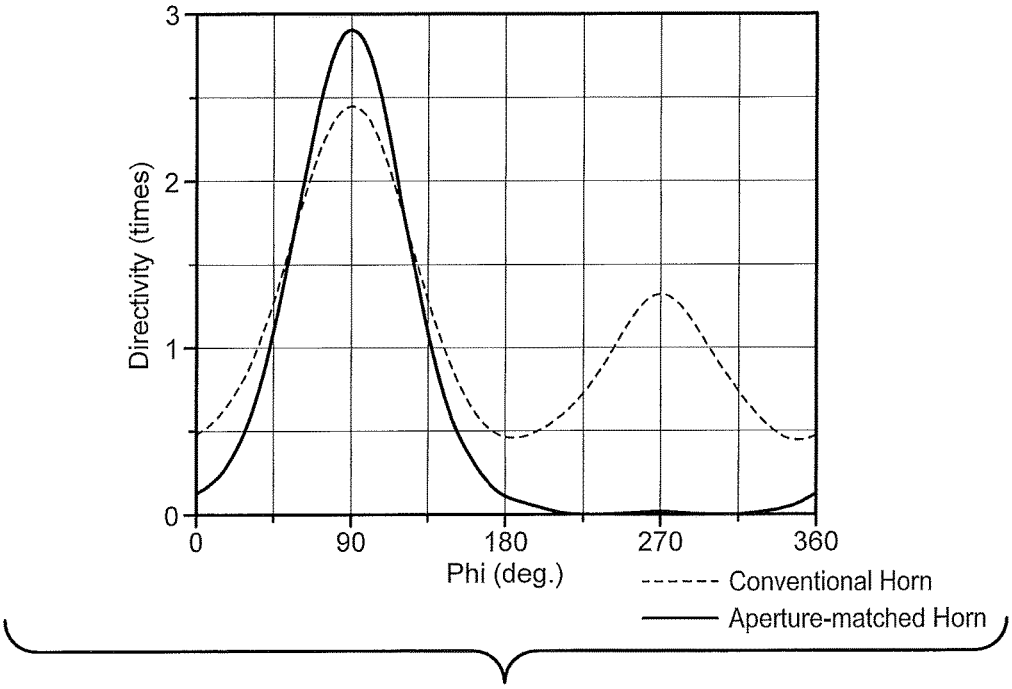
FIG. 4B is a second graph comparing linear directivity between a conventional TEM horn antenna and the TEM horn array antenna system of FIG. 1 with respect to a second polarization (Phi) at the output of the antenna and the angel with respect to the center boresight of the antenna.

FIG. 4A and FIG. 4B illustrate some of the results using the TEM antenna system 10. These graphs indicate improved performance of the TEM antenna system 10 over the conventional TEM horn antenna system. As depicted in FIG. 4A and FIG. 4B, the graph particularly illustrates the improvement of the performance of directivity of a signal of the TEM antenna system 10. Directivity is defined the radiation of the peak energy going in the forward lobe to the energy that would be radiated in that direction for an isotropic radiator. Theta (shown in FIG. 4A) and Phi (shown in FIG. 4B) are essential two directions of radiation, as the gain profile would be a lobe. Ideally, the best TEM antenna will use all energy into the forward direction (forward lobe) and no energy goes to the backward direction (back lobe). Theta is a first polarization at the output of the antenna and the angel with respect to the center boresight of the antenna. Phi is a second polarization at the output of the antenna and the angel with respect to the center boresight of the antenna.

As illustrated, since the forward lobe is at the 90 degree direction and the back lobe is at 270 degree, the forward lobe is much higher than the conventional TEM horn antenna, whereas back lobe is significantly reduced than the conventional TEM horn antenna. As depicted in FIG. 4A and FIG. 4B, the directivity of the forward lobe at 90 degree is improved from 2.45 to 2.9, which is improved by around 18%. On the contrary, the directivity of the back lobe at 270 degree is improved from 1.3 to 0, which is improved by around 100%.

Figure 5:
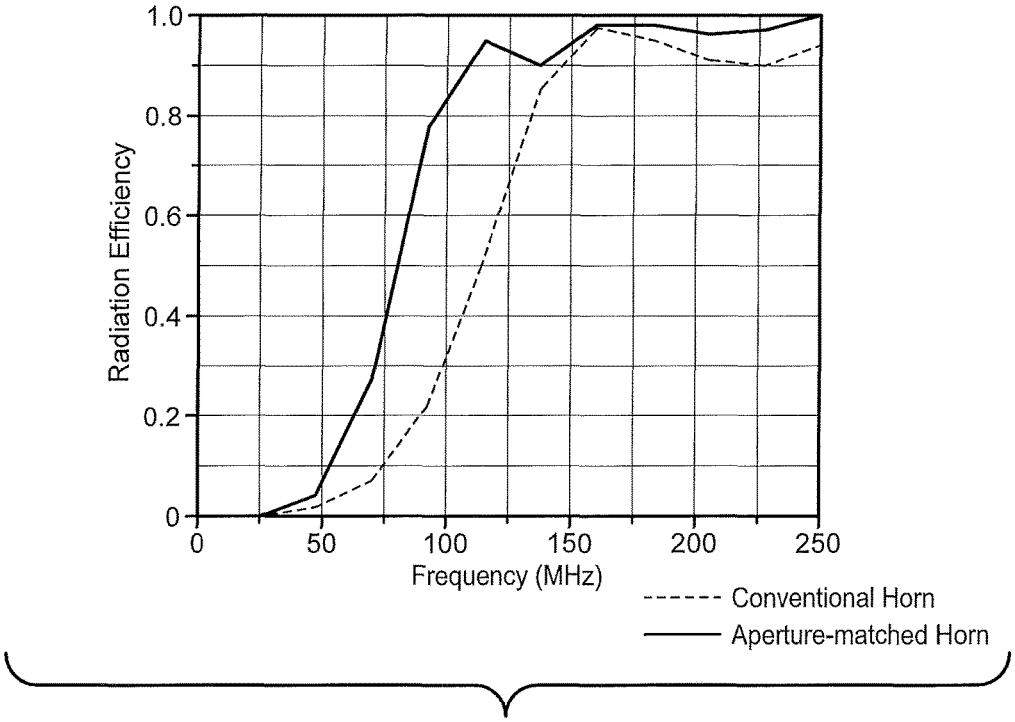
FIG. 5 is a graph comparing radiation efficiency between a conventional TEM antenna and the TEM horn array antenna system of FIG. 1 with respect to frequency band of 150-250 MHz.

FIG. 5 illustrates the radiation efficiency of the TEM antenna system 10 over the conventional TEM horn antenna in term of frequency. Radiation efficiency is the ratio, at a given frequency, between the power radiated by the antenna to the power supplied to the antenna. It does not take into account the direction of radiation, forward, back, side lobes, or the like. Rather, it is simply the percentage of energy radiated compared to the energy fed to the antenna at specific frequency bands. Particularly, the TEM antenna system 10 is designed for the frequency range of 150-250 MHz. As shown, the radiation efficiency between 150 and 250 MHz is close to 1, which is improved from as little as around 0.5% to as much as around 7.2% over the conventional TEM horn antenna. This graph also indicates that the radiation efficiency is improved to be near 1 without compensating improvement of forward directivity (forward lobe) and reducing backward directivity (back lobe).

It is understood that the TEM antenna system 10 is aperture matched TEM antenna which means that the size and the radius of the back lobe-reducing cylindrical shaped portions 29, 30 is matched to the wavelength and overall antenna aperture. Furthermore, it is understood that the radius of curved section 36 is matched to the TEM horn antenna 10 to filter out the back lobe radiation and is related to the antenna size and the wavelength.

It is understood that the dielectric plates 26, 27 are made out of Rogers® dielectric material. The dielectric foam structure 24 has similar electrical properties as air. However, the foam structure 24 provides structural support between the top metal layer 22 and the bottom metal layer 23.

Furthermore, the figures depict the use of four TEM horn antennas 20A-20D, however this is not intended to be limiting. The depiction of four antennas was utilized to make an array since experimentation with discrete elements enables the combination of four individual generators coherently. More could be used; or less could be used. However, the size of each antenna would change, as the total aperture must be a minimum size in order to ensure reasonable radiation efficiency.

It is understood that the dimension or the size of the TEM antenna 20 and the TEM array antenna system 10 may be different than the current embodiment for different frequency ranges and purposes.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the present disclosure is not limited to the exact details shown or described.

What is claimed is:

1. A transverse electromagnetic (TEM) horn antenna comprising:

a parallel plate waveguide section, wherein the parallel plate waveguide section comprises an upper dielectric plate and a lower dielectric plate;

an exponentially flared section, wherein the exponentially flared section comprises a top surface and bottom surface;

a curved section, wherein the curved section comprises a first curved section and a second curved section; and wherein a first end of the exponentially flared section is connected with the parallel plate waveguide section and a second end of the exponentially flared section is connected with the curved section, and the first curved section and the second curved section extend from the second end of the exponentially flared section to a free terminal end at a uniform radius of curvature.

2. The TEM horn antenna of claim 1, wherein the terminal end is located less than 360 degrees from a connection of the curved section with the second end of the exponential flare section.

3. The TEM horn antenna of claim 1, further comprising a first cylindrical piece of foam positioned within the first curved section and a second cylindrical piece of foam positioned within the second curved section.

4. The TEM horn antenna of claim 1, wherein a metal layer is provided on an outer surface of the parallel plate waveguide section, the exponential tapered flare section, and the curved section.

5. The TEM horn antenna of claim 1, wherein a radius of curvature of the flare section is greater than a radius curvature of the curved section.

6. The TEM horn antenna claim 1, in combination with three other identical antennas arranged in an array to define a TEM horn antenna array system.

7. The TEM horn antenna of claim 1, wherein uniform radius of curvature is in a range from about 4 inches to about 6 inches.

8. A transverse electromagnetic (TEM) horn antenna comprising:

a parallel plate waveguide section, wherein the parallel plate waveguide section comprises an upper dielectric plate and a lower dielectric plate;

an exponentially flared section, wherein the exponentially flared section comprises a top surface and bottom surface;

a curved section including a first curved portion and a second curved portion, wherein the first curved portion and the second curved portion each curve less than 360 degrees to a terminal end and have a substantially uniform radius of curvature; and wherein a first end of the exponentially flared section is connected with the parallel plate waveguide section and a second end of the exponential flare section is connected with the curved section.

* * * * *